US005991917A

United States Patent [19]

Kaake

[11] Patent Number: 5,991,917

[45] Date of Patent: Nov. 30, 1999

[54] BALL GLOVE WITH HEEL POCKET

[76] Inventor: Steven A. F. Kaake, 3402 Deerwood Dr., New Albany, Ind. 47150

[21] Appl. No.: 09/038,452

[22] Filed: Mar. 11, 1998

Related U.S. Application Data

[60] Provisional application No. 60/040,751, Mar. 13, 1997, abandoned.

[51] Int. Cl.[6] ..... A41D 13/10

[52] U.S. Cl. ..... 2/19

[58] Field of Search ..... 2/19, 159, 160, 2/161.1

[56] References Cited

U.S. PATENT DOCUMENTS 936,437 10/1909 Fields et al. .
970,754 9/1910 Rogers ..... 2/19
1,640,004 8/1927 Lundblad .
3,994,024 11/1976 Bates ..... 2/19
4,541,127 9/1985 Gould .
4,637,610 1/1987 Carr ..... 2/19
4,817,209 4/1989 Lehmann et al. ..... 2/19
4,847,915 7/1989 Keene ..... 2/19
5,448,775 9/1995 Yamada et al. .
5,457,819 10/1995 Aoki .

*Primary Examiner*—Michael A. Neas
*Attorney, Agent, or Firm*—David C. Purdue; John C. Purdue

[57] ABSTRACT

An improved baseball glove, including a heel pocket is disclosed. The heel pocket opens and closes when the glove is manipulated between open and closed positions. The heel pocket comprises a web, first and second end flaps, each having an upper edge and a base edge. The base edges are secured to the heel of the glove and the end flaps are secured to the thumb stall and the little finger stall.

1 Claim, 5 Drawing Sheets

BALL GLOVE WITH HEEL POCKET

REFERENCE TO RELATED APPLICATION

This is a continuation of application Ser. No. 60/040,751 filed Mar. 13, 1997, now abandoned.

FIELD OF THE INVENTION

This invention relates generally to the field of ball gloves, i.e., baseball mitts. A ball glove according to the invention includes a heel pocket which is connected to the glove so that it opens and closes with the glove to trap a ball.

BACKGROUND OF THE INVENTION

Baseball gloves come in a wide variety of shapes and sizes. There are gloves that are specifically configured according to the position of the player that will be using the glove. Examples include fielder's gloves, first base man's gloves and catcher's gloves. During a review of patents related to the present invention, several patents, discussed below, were noted.

U.S. Pat. No. 936,437 (Fields et al.) discloses a glove including a pocket. The glove has a cuff made of flaps and includes a pouch attached to the cuff. The glove is not a ball glove and the pocket is adapted to receive and hold coins so that they will be conveniently at hand, when needed.

U.S. Pat. No. 1,640,004 (Lundblad) discloses a fruit picker's glove including a pouch which is secured to the heel portion of the glove and to the little finger and thumb stalls. Preferably, a can is carried in the pouch to collect and hold berries.

U.S. Pat. No. 3,994,024 (Bates) discloses a wrist protector for use with a catcher's mitt. The protector comprise a pad which is stitched or laced to the heel portion of the glove so that they are connected by a flexible joint.

U.S. Pat. No. 4,541,127 (Gould) discloses a ball glove including a forearm protecting shield which is connected to the heel of the glove, preferably with existing glove lacing. The shield encircles the forearm of the user and includes shock absorbing materials.

U.S. Pat. No. 4,817,209 (Lehmann et al.) discloses a child's baseball glove which includes a padded retainer member which extends along, but is not connected to, the heel of the glove. The ends of the padded retainer member are releasably connected to opposite sides of the glove and can be removed when it is deemed to be no longer to be necessary.

U.S. Pat. No. 4,847,915 (Keene) discloses a baseball glove with a flexible heel construction. The glove has a carefully constructed heel including a heel pad and a flexible heel pad positioned and secured to the glove so that closing of the glove is facilitated.

U.S. Pat. No. 5,448,775 (Yamada et al.) discloses a baseball glove having enhanced flexibility achieved, primarily, through a slit formed in the web portion of the glove adjacent to the base of the little finger stall.

U.S. Pat. No. 5,457,819 (Aoki) discloses a baseball glove including an adjustable wrist protector. The glove has a wrist closure mechanism which includes an adjustable wrist protector.

SUMMARY OF THE INVENTION

The present invention is an improvement in a ball glove comprising a thumb stall having a first, outside edge and at least one finger stall having a first, outside edge. The thumb stall has a second, inner edge which is closest to the at least one finger stall and the at least one finger stall has a second edge which is closest to the thumb stall. The glove is moveable, by a hand inserted the stalls, between a first, open position and a second, closed position. The glove includes a first pocket connected to the second, inside edges of the positioned so that, when the glove is in the first position, the pocket is open so that a baseball or the like is easily received therein and so that, when the glove is moved to the second position, the pocket closes so that it is operable to retain a baseball or the like within the pocket.

The improvement according to the present invention resides in a heel pocket which is connected to or can be attached to the heel of a glove of the type described immediately above. The heel pocket, which is preferably made of leather or a leather-like material, comprises a web having a base edge, an upper edge and first and second opposed end flaps each having a base edge, an upper edge and an end. The base edge of the first end flap is connected, as by stitching, lacing or the like, to the glove adjacent to the lower end of the first outside edge of the thumb stall. The base edge of the second end flap is connected, as by stitching, lacing or the like, to the glove adjacent the lower end of the first outside edge of the at least one finger stall. Preferably, the base edge of the web is connected, as by stitching, lacing or the like, to the glove adjacent the lower end of the heel. It is also preferred that the end of the first end flap be connected to thumb stall, adjacent to the outside edge thereof and that the end of the second end flap be connected to the at least one finger stall, adjacent to the outside edge thereof.

Accordingly, it is an object of the present invention to provide a ball glove which includes a second pocket, i.e., a heel pocket which is connected to the heel of the glove so that, when the glove is opened, the heel pocket is opened so that it may receive a ball and, when the glove is closed, the heel pocket is thereby closed so that it holds a ball.

It is a further object of the present invention to provide a ball glove which is especially equipped to catch a ball as it takes a high hop.

It is yet another object of the invention to provide a ball glove with a self closing heel pocket.

These and other objects will be apparent to those skilled in the art from the following detailed description of the instant invention.

DESCRIPTION OF THE PREFERRED EMBODIMENT

Figure 1:
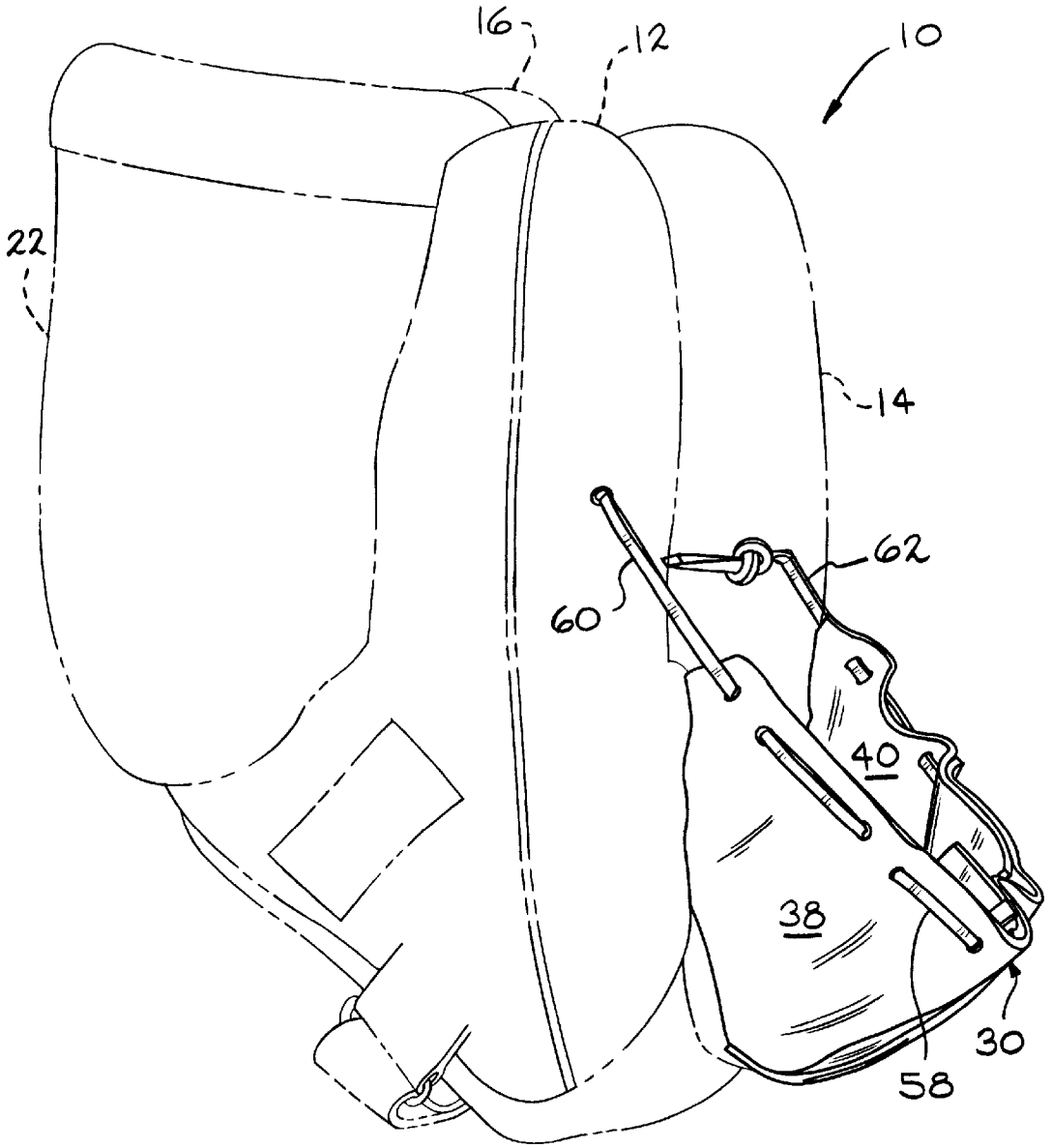
FIG. 1 is a side view of a ball glove in a palm-up orientation, including a heel pocket according to the invention.
Figure 2:
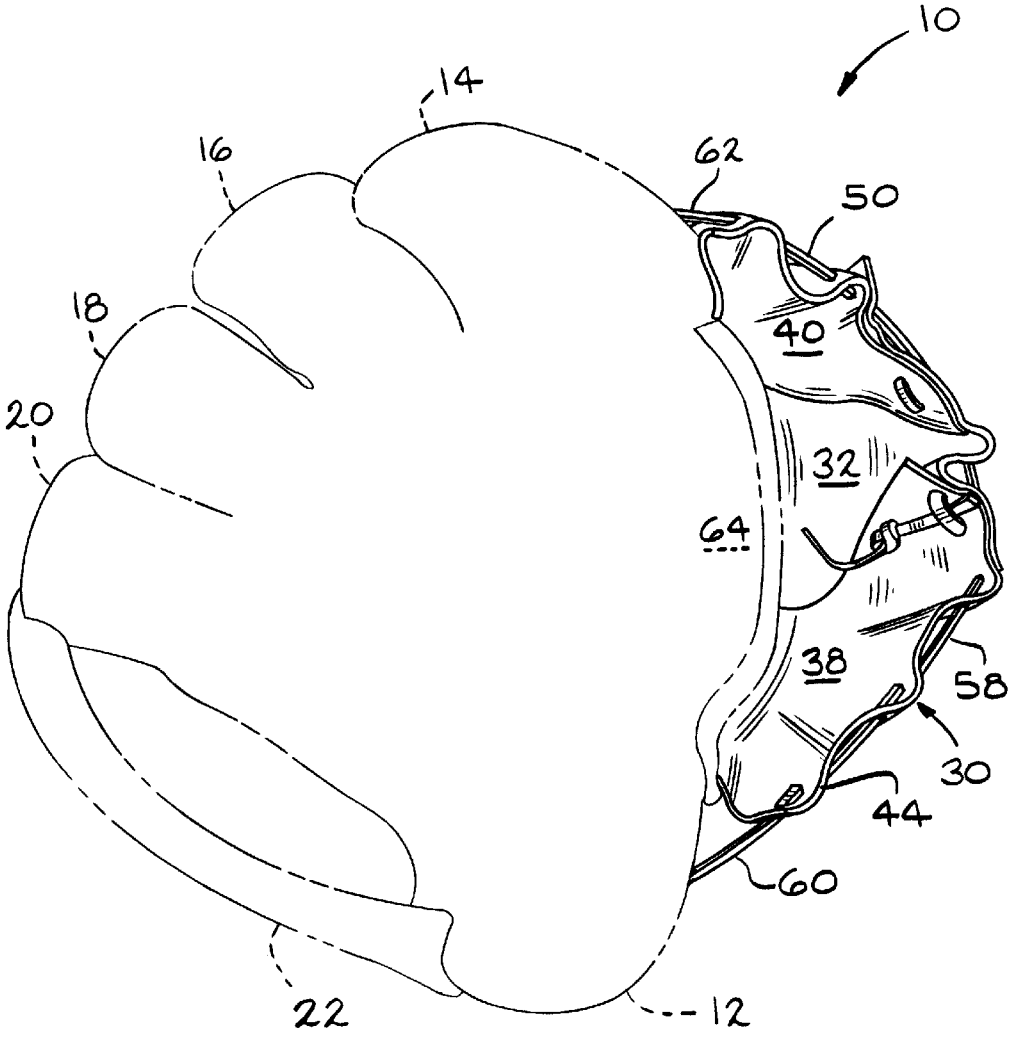
FIG. 2 is a side view, ninety degrees removed from the side view shown in FIG. 1, of the glove shown in FIG. 1, showing the ball glove and the heel pocket in a first, open position.
Figure 3:
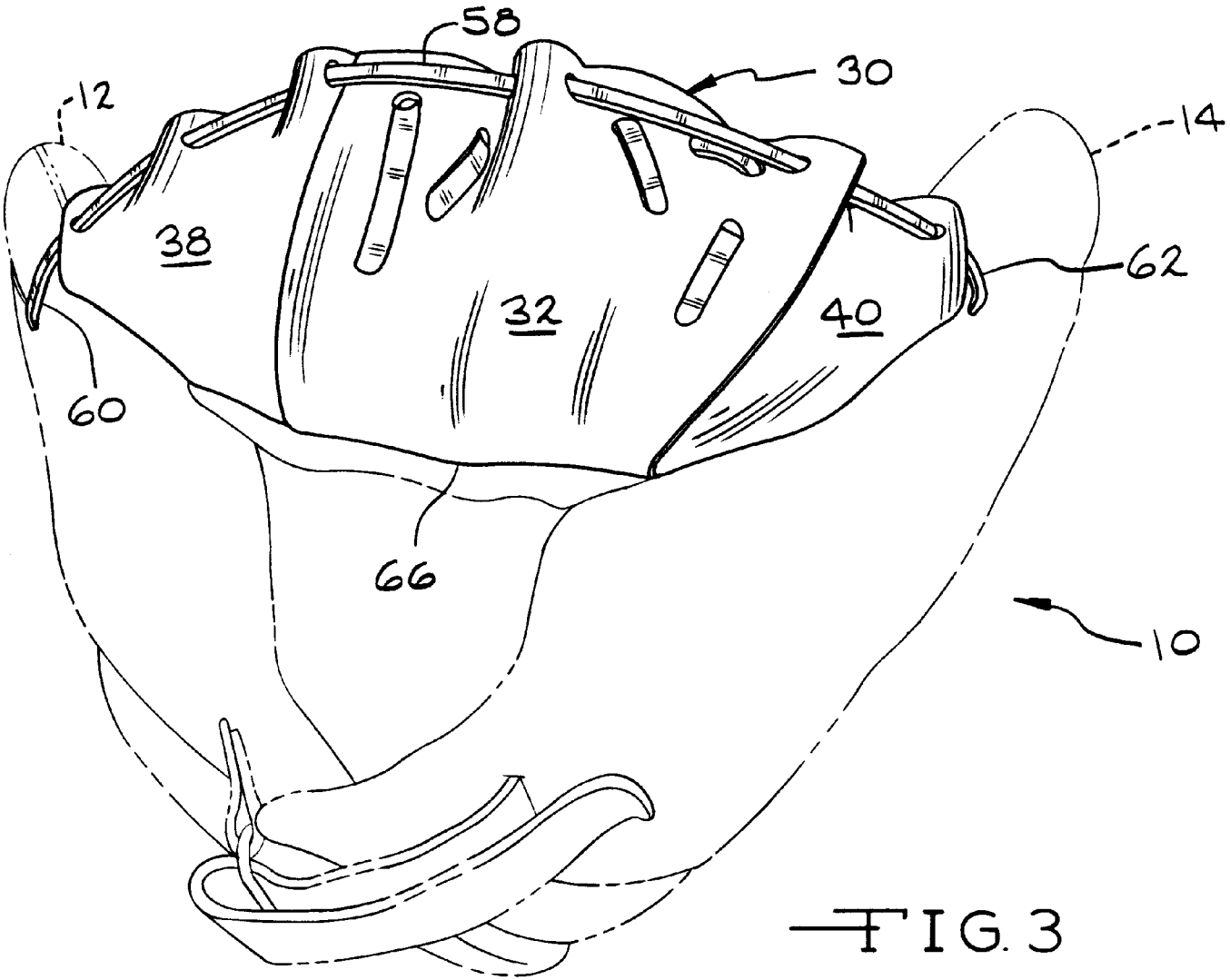
FIG. 3 is a side view, one-hundred and eighty degrees removed from the side view shown in FIG. 1, of the glove shown in FIG. 1, showing the ball glove and the heel pocket in a first, open position.

Referring to FIGS. 1, 2 and 3, a ball glove including a heel pocket according to the present invention is indicated generally at 10. The glove 10, shown is phantom, comprises a thumb stall 12, a little finger stall 14, a ring finger stall 16, a middle finger stall 18 and an index finger stall 20. A conventional pocket 22 is stitched or laced to the glove 10 between the thumb stall 12 and the index finger stall 20. In a conventional manner, the glove 10 is movable between a first, open position, as shown in FIGS. 1 through 3 in which the pocket 22 is open and operable to receive a ball and a second, closed position in which the pocket is operable to trap a ball. Movement of the glove between the first and second positions is effected manually, i.e., by the corresponding movement of a hand, the fingers and thumb of which are received in the finger and thumb stalls. These and many other features of the glove 10 are largely conventional and further description thereof is believed to be unnecessary to reaching an understanding of the present invention. The glove pictured in the drawing is a Joel Youngblood signature model which is marketed under the trademark "Regent". The glove has been modified to include a heel pocket in accordance with the present invention.

Figure 4:
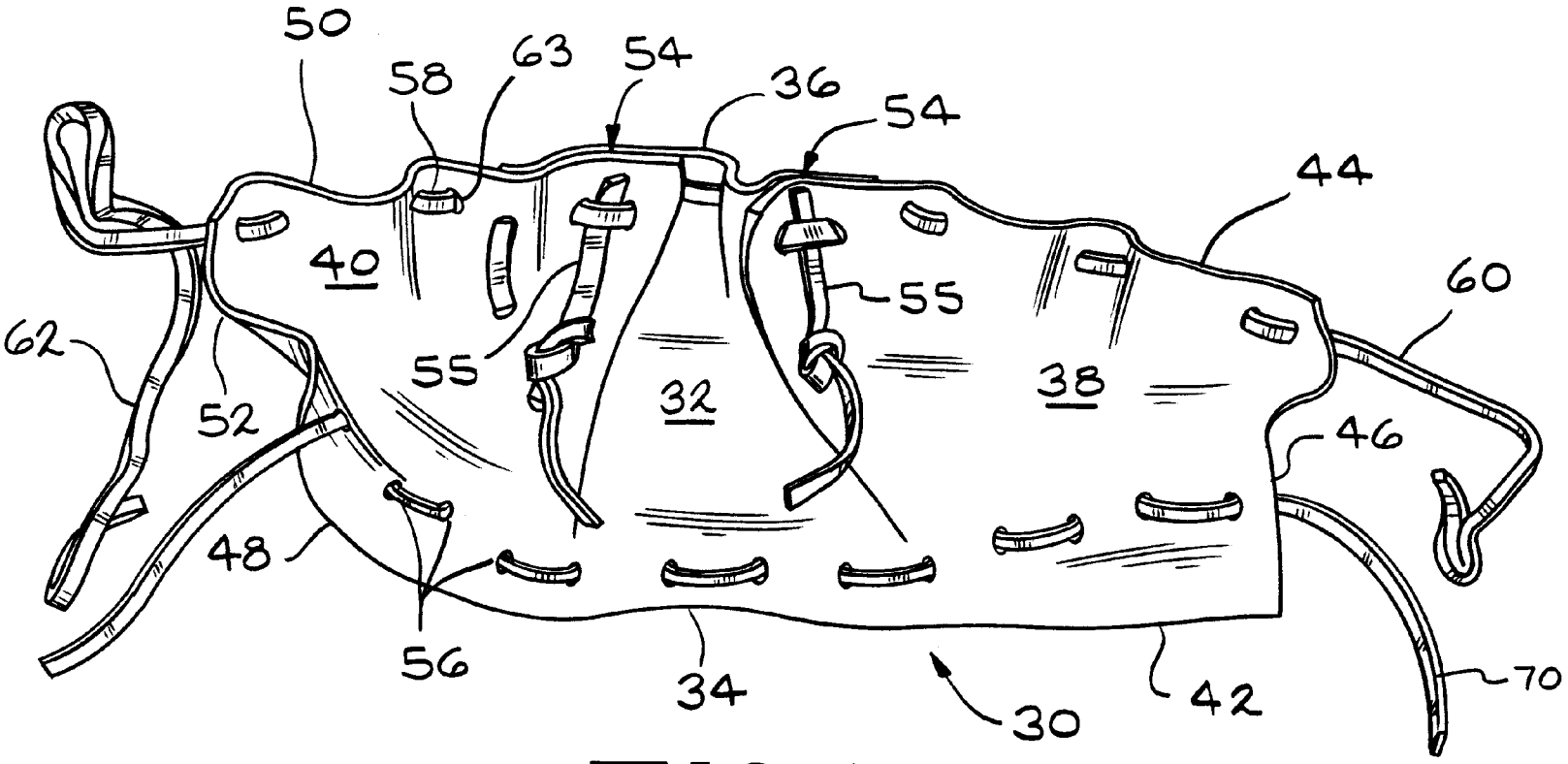
FIG. 4 is a view showing the heel pocket according to the invention, separated from the ball glove shown in FIGS. 1 through 3.

Referring now to FIG. 4, the glove includes a heel pocket, indicated generally as 30, which, in use, is connected to the glove 10 as shown in FIGS. 1 through 3 and 5. The heel pocket 30, which is preferably made of leather or a leather-like material, comprises a central web 32 (see FIG. 4) having a base edge 34, an upper edge 36, a first end flap 38 and a second, opposed end flap 40. The end flap 38 has a base edge 42, an upper edge 44 and an end 46. Similarly, the end flap 40 has a base edge 48, an upper edge 50 and an end 52. The web 32 which constitutes the heel pocket 30 is constructed so that it naturally forms a pocket shape, owing primarily to the inclusion of at least one pocket former, two of which are indicated at 54. The pocket formers 54 are formed by cutting the web from the upper edge 36 towards the base edge 34 so that the cut extends a substantial distance down the web 32. Triangularly shaped portions of the web, adjacent to the cut, are overlapped and stitched, laced or otherwise secured to each other to constitute a pocket former. Lacing securing the triangularly shaped portions is indicated at 55. It will be appreciated that triangularly shaped portions, corresponding with the overlapping triangularly shaped portions can be removed from the web leaving edges which can be stitched, laced or otherwise secured to each other to constitute pocket formers. Other pocket former constructions will undoubtedly occur to those skilled in the art and are intended to be included in the term pocket former, as used herein and in the appended claims. Preferred pocket formers, such as shown in the drawing, cause the heel pocket to have a configuration corresponding with that shown in FIG. 1.

The heel pocket 30, as shown in FIGS. 1 through 3 and 5, can be secured to a ball glove such as the glove 10. Such securement can be effected in innumerable ways to achieve the functions performed by the heel pocket. The best mode presently known to the inventor for securing the heel pocket 30 to a glove, is illustrated in the drawing. Specifically, a row of apertures, several of which are indicated at 56, are provided in the web 32 and the end flaps 38 and 40, adjacent to the base edges 34, 42 and 48 thereof. As discussed below, in more detail, the base edges are secured to the heel of a glove. In addition, a lace 58 constitutes a first, thumb connector 60, which is a first end of the lace 58, and constitutes a second finger stall connector 62, which is a second end of the lace 58. It is preferred that the lace be laced through and frictionally retained in apertures, indicated at 63 in FIG. 4, formed in the web 32 and end flaps 38 and 40, adjacent to the upper edges 36, 44 and 50 thereof. The connectors are operable, as discussed below, to connect the end flaps 38 and 40 of the web 32 to the thumb stall and the little finger stall.

The heel pocket 30 is connected to a glove, as shown in FIGS. 1 through 3 and 5 so that the base edge 34 of the central web 32 is connected to the glove adjacent to the heel portion thereof. This is accomplished, in the preferred embodiment, by securing the central web and end flap base edges 34, 42 and 48 between an inside palm layer 64 (FIG. 2) and an outside palm layer 66 (FIG. 3) of the glove 10. It is preferred that these three components be laced together by lacing 70, as shown in FIG. 4 of the drawings although other modes of connecting these elements are certainly within the purview of the invention. Although all three base edges, 34, 42 and 48, are shown as being secured between the inside palm layer 64 (FIG. 2) and the outside palm layer 66 (FIG. 3), it will be appreciated that satisfactory results can be obtained in the case where less than all three of the base edges 34, 42 and 48, are so secured. For example, the base edge 34 may be secured while the base edges 42 and 48 are not secured. Alternatively, the base edge 34 may be unsecured while base edges 42 and 48 are secured.

The first connector 60 is secured to the glove 10 and, as shown in FIG. 2, to the thumb stall 12. The second connector 62 is secured to the glove 10 and, as shown in FIGS. 2 and 3, to the little finger stall 14. It is preferred that the end flap connectors 60 and 62 be secured to their respective stalls, near the mid-points of the stalls, although other attachment points can be utilized, so long as the heel pocket 30 performs in the manner described below.

Figure 5:
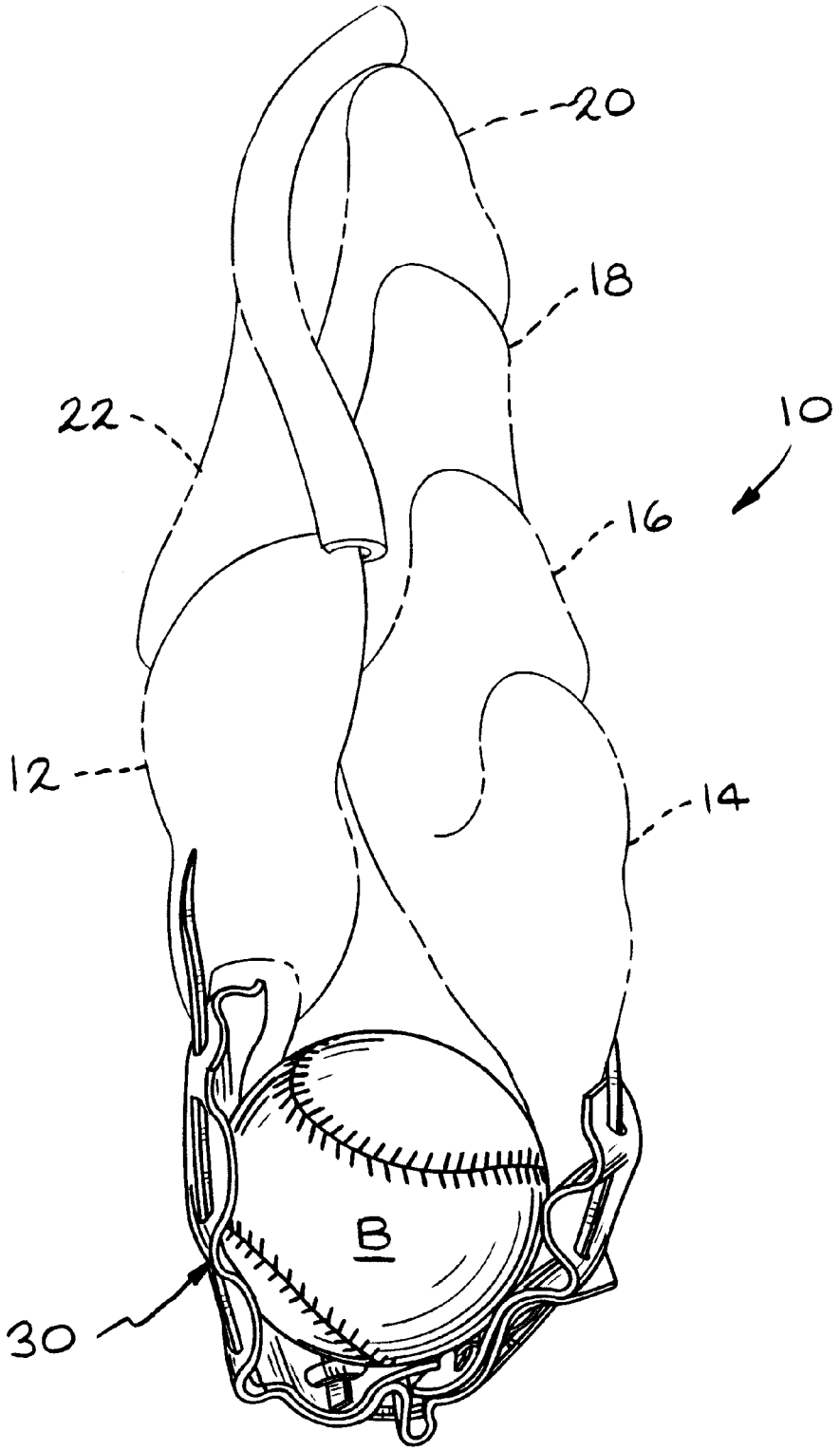
FIG. 5 is a side view of a ball glove in a palm-up orientation, corresponding with the view shown in FIG. 1 except that the ball glove and the heel pocket are in a second, closed position.

Referring again to FIG. 2, the glove 10 and the heel pocket are shown in a first, open position in which the pocket 22 and the heel pocket 30 are open to receive a ball. When the glove 10 is manipulated to a second closed position, as shown in FIG. 5, the pockets 22 and 30 are closed so that a ball, B, will be frictionally retained in the heel pocket 30. In other words, the heel pocket is secured to the glove 10, in the manner described or suggested above, so that when the glove is manipulated to a first, open position, the heel pocket is open and operable to receive a ball and, when the glove 10 is manipulated to a second, closed position, the heel pocket 30 is operable to frictionally hold a ball.

The foregoing description is intended to enable one skilled in the art to practice the present invention and sets forth the best mode presently known to the inventor. Undoubtedly, numerous variations and modifications will occur to those skilled in the art and such modifications may be resorted to without departing from the spirit and scope of the invention disclosed herein and claimed below.

I claim:

1. A baseball glove which can be manipulated between a first, open position and a second, closed position, said glove comprising a thumb stall, an index finger stall, a little finger stall, a first pocket forming web connected to and supported between said thumb stall and said index finger stall, a heel, and a heel pocket comprising a web having an upper edge and a base edge, first and second end flaps each having an upper edge, a base edge and an end, a connector connecting at least one of said base edges to said heel portion, a connector connecting said first end flap end to said thumb stall, and a connector connecting said second end flap end to said little finger stall, wherein, said heel pocket is connected to said glove so that, when the glove is manipulated to the open position, said heel pocket is opened and operable to receive a ball and so that, when said glove is manipulated to the closed position, said heel pocket is closed and operable to frictionally retain a ball therein.

* * * * *